US006118407A

United States Patent [19]

Anderson

[11] Patent Number: 6,118,407

[45] Date of Patent: Sep. 12, 2000

[54] HORIZONTAL PLASMA ANTENNA USING PLASMA DRIFT CURRENTS

[75] Inventor: Theodore R. Anderson, West Greenwich, R.I.

[73] Assignee: The United States of America as represented by the Secretary of the Navy, Washington, D.C.

[21] Appl. No.: 09/285,176

[22] Filed: Mar. 23, 1999

[51] Int. Cl.[7] ..... H01Q 1/26

[52] U.S. Cl. ..... 343/701; 343/720

[58] Field of Search ..... 343/701, 721, 343/720; 315/111.21; H01Q 1/26

[56] References Cited

U.S. PATENT DOCUMENTS

| | | | |
|---|---|---|---|
| 3,914,766 | 10/1975 | Moore | 343/701 |
| 5,017,835 | 5/1991 | Oechsner | 315/111.81 |
| 5,225,740 | 7/1993 | Ohkawa | 315/111.41 |
| 5,450,223 | 9/1995 | Wagner et al. | 359/124 |
| 5,594,456 | 1/1997 | Norris et al. | 343/701 |
| 5,648,701 | 7/1997 | Hooke et al. | 315/111.21 |

*Primary Examiner*—Don Wong
*Assistant Examiner*—Hoang Nguyen
*Attorney, Agent, or Firm*—Michael J. McGowan; Robert W. Gauthier; Prithvi C. Lall

[57] ABSTRACT

A horizontal plasma antenna is provided. An ionizer generates an ionizing beam through a horizontal tube to form a bounded plasma column extending along a horizontal axis in a gravity field. An amplitude or frequency modulating signal is applied to Helmholtz coils to control a horizontal magnetic field that is perpendicular to the horizontal axis. The resulting changes in the magnetic field produce a drift current in the plasma that, in turn, radiates an amplitude or phase modulated electromagnetic field from the plasma column.

19 Claims, 3 Drawing Sheets

HORIZONTAL PLASMA ANTENNA USING PLASMA DRIFT CURRENTS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention relates generally to communications antennas, and more particularly to plasma antennas adaptable for use in any of a wide range of frequencies.

(2) Description of the Prior Art

A specific antenna typically is designed to operate over a narrow band of frequencies. However, the underlying antenna configuration or design may be adapted or scaled for widely divergent frequencies. For example, a simple dipole antenna design may be scaled to operate at frequencies from the 3–4 MHz band up to the 100 MHz band and beyond.

At lower frequencies the options for antennas become fewer because the wavelengths become very long. Yet there is a significant interest in providing antennas for such lower frequencies including the Extremely Low Frequency (ELF) band, that is less than 3 kHz, the Very Low Frequency (VLF) band including signals from 20 kHz to 60 kHz and the Low Frequency (LF) band with frequencies in the 90 to 100 kHz band. However, conventional half-wave and quarter-wave antenna designs are difficult to implement because at 100 Hz, for example, a quarter-wave length is of the order of 750 km.

Notwithstanding these difficulties, antennas for such frequencies are important because they are useful in specific applications, such as effective communications with a submerged submarine. For such applications, conventional ELF antennas comprise extremely long, horizontal wires extended over large land areas. Such antennas are expensive to construct and practically impossible to relocate at will. An alternative experimental Vertical Electric Dipole (VEP) antenna uses a balloon to raise one end of a wire into the atmosphere to a height of up to 12 km or more. Such an antenna can be relocated. To be truly effective the antenna should extend along a straight line. Winds, however, can deflect both the balloon and wire to produce a catenary form that degrades antenna performance. Other efforts have been directed to the development of a corona mode antenna. This antenna utilizes the corona discharges of a long wire to radiate ELF signals.

Still other current communication methods for such submarine and other underwater environments include the use of mast mounted antennas, towed buoys and towed submersed arrays. While each of these methods has merits, each presents problems for use in an underwater environment. The mast of current underwater vehicles performs numerous sensing and optical functions. Mast mounted antenna systems occupy valuable space on the mast which could be used for other purposes. For both towed buoys and towed submersed arrays, speed must be decreased to operate the equipment. Consequently, as a practical matter, the use of such antennas for ELF or other low frequency communications is not possible because they require too much space.

Conventional plasma antennas are of interest for communications with underwater vessels since the frequency, pattern and magnitude of the radiated signals are proportional to the rate at which the ions and electrons are displaced. The displacement and hence the radiated signal can be controlled by a number of factors including plasma density, tube geometry, gas type, current distribution, applied magnetic field and applied current. This allows the antenna to be physically small, in comparison with traditional antennas. Studies have been performed for characterizing electromagnetic wave propagation in plasmas. Therefore, the basic concepts, albeit for significantly different applications, have been investigated.

With respect to plasma antennas, U.S. Pat. No. 1,309,031 to Hettinger discloses an aerial conductor for wireless signaling and other purposes. The antenna produces, by various means, a volume of ionized atmosphere along a long beam axis to render the surrounding atmosphere more conductive than the more remote portions of the atmosphere. A signal generating circuit produces an output through a discharge or equivalent process that is distributed over the conductor that the ionized beam defines and that radiates therefrom.

U.S. Pat. No. 3,404,403 to Vellase et al. uses a high power laser for producing the laser beam. Controls repeatedly pulse and focus the laser at different points thereby to ionize a column of air. Like the Hettinger patent, a signal is coupled onto the ionized beam.

U.S. Pat. No. 3,719,829 to Vaill discloses an antenna constructed with a laser source that establishes an ionized column. Improved ionization is provided by means of an auxiliary source that produces a high voltage field to increase the initial ionization to a high level to form a more highly conductive path over which useful amounts of electrical energy can be conducted for the transmission of intelligence or power. In the Hettinger, Vellase et al. and Vaill patents, the ionized columns merely form vertical conductive paths for a signal being transmitted onto the path for radiation from that path.

U.S. Pat. No. 3,914,766 to Moore discloses a pulsating plasma antenna, which has a cylindrical plasma column and a pair of field exciter members parallel to the column. The location and shape of the exciters, combined with the cylindrical configuration and natural resonant frequency of the plasma column, enhance the natural resonant frequency of the plasma column, enhance the energy transfer and stabilize the motion of the plasma so as to prevent unwanted oscillations and unwanted plasma waves from destroying the plasma confinement.

U.S. Pat. No. 5,450,223 to Wagner et al. discloses an optical demultiplexer for optical/RF signals. The optical demultiplexer includes an electro-optic modulator that modulates a beam of light in response to a frequency multiplexed radio-frequency information signal.

U.S. Pat. No. 5,594,456 to Norris et al. discloses an antenna device for transmitting a short pulse duration signal of predetermined radio frequency. The antenna device includes a gas filled tube, a voltage source for developing an electrically conductive path along a length of the tube which corresponds to a resonant wavelength multiple of the predetermined radio frequency and a signal transmission source coupled to the tube which supplies the radio frequency signal. The antenna transmits the short pulse duration signal in a manner that eliminates a trailing antenna resonance signal. However, as with the Moore antenna, the band of frequencies at which the antenna operates is limited since the tube length is a function of the radiated signal.

A number of other references disclose various components for the production of ion beams and ion plasma. For example, U.S. Pat. No. 5,017,835 to Oeschner discloses a high-frequency ion source for production of an ion beam. The source comprises a tubular vessel shaped to match the desired shape of the beam and designed to accommodate an ionizable gas. A coil surrounds the vessel and is coupled to a high-frequency generator through a resonant circuit. A Helmholtz coil pair matched to the shape of the vessel generates a magnetic field directed normally to the axis of the coil surrounding the vessel.

U.S. Pat. No. 5,225,740 to Ohkawa discloses a method and apparatus for producing a high density plasma. The plasma is produced in a long cylindrical cavity by the excitation of a high-frequency whistler wave within the cavity. This cavity and the plasma are imbedded in a high magnetic field with magnetic lines of force passing axially or longitudinally through the cavity. Electromagnetic energy is then coupled axially into the cylindrical cavity using a resonant cavity. In one embodiment electromagnetic energy is coupled radially into the cylindrical cavity using a slow wave structure.

U.S. Pat. No. 5,648,701 to Hooke et al. discloses electrode designs for high pressure magnetically assisted inductively coupled plasmas. The plasma is formed in a vessel at a pressure of at least 100 mtorr. An antenna with a substantially planar face is positioned adjacent a portion of the vessel for applying an electromagnetic field to the plasma gas thereby to generate and maintain a plasma. Another magnetic field is also applied with a component in a direction substantially perpendicular to the planar face of the antenna.

Notwithstanding the disclosures in the foregoing references, applications for ELF frequencies still use conventional land-based antennas, commonly called Horizontal Electric Dipole (HED) antennas. There remains a requirement for an antenna that can be mast mounted or otherwise use significantly less space than the existing conventional land-based antennas for enabling the transmission of signals at various frequencies, included ELF and other low-frequency signals, for transmission in an underwater environment.

SUMMARY OF THE INVENTION

Accordingly it is an object of the present invention to provide an antenna capable of operation with ELF signals.

Another object of this invention is to provide an antenna that is capable of transmitting signals in different frequency ranges including the ELF range.

Still another object of this invention is to provide an ELF antenna that is transportable.

Yet another object of this invention is to provide an ELF antenna that can be mounted in a restricted volume.

In accordance with this invention, an antenna is formed by generating a plasma column extending along a horizontal axis in a gravity field. A magnetic field in a horizontal plane is directed perpendicularly to the horizontal axis. A modulating signal controls the magnetic field so that variations in the field produce a drift current in the plasma. The drift current varies in accordance with the modulating signal and radiates an electromagnetic field that is at the frequency of and varies in accordance with the modulating signal.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

Figure 1:
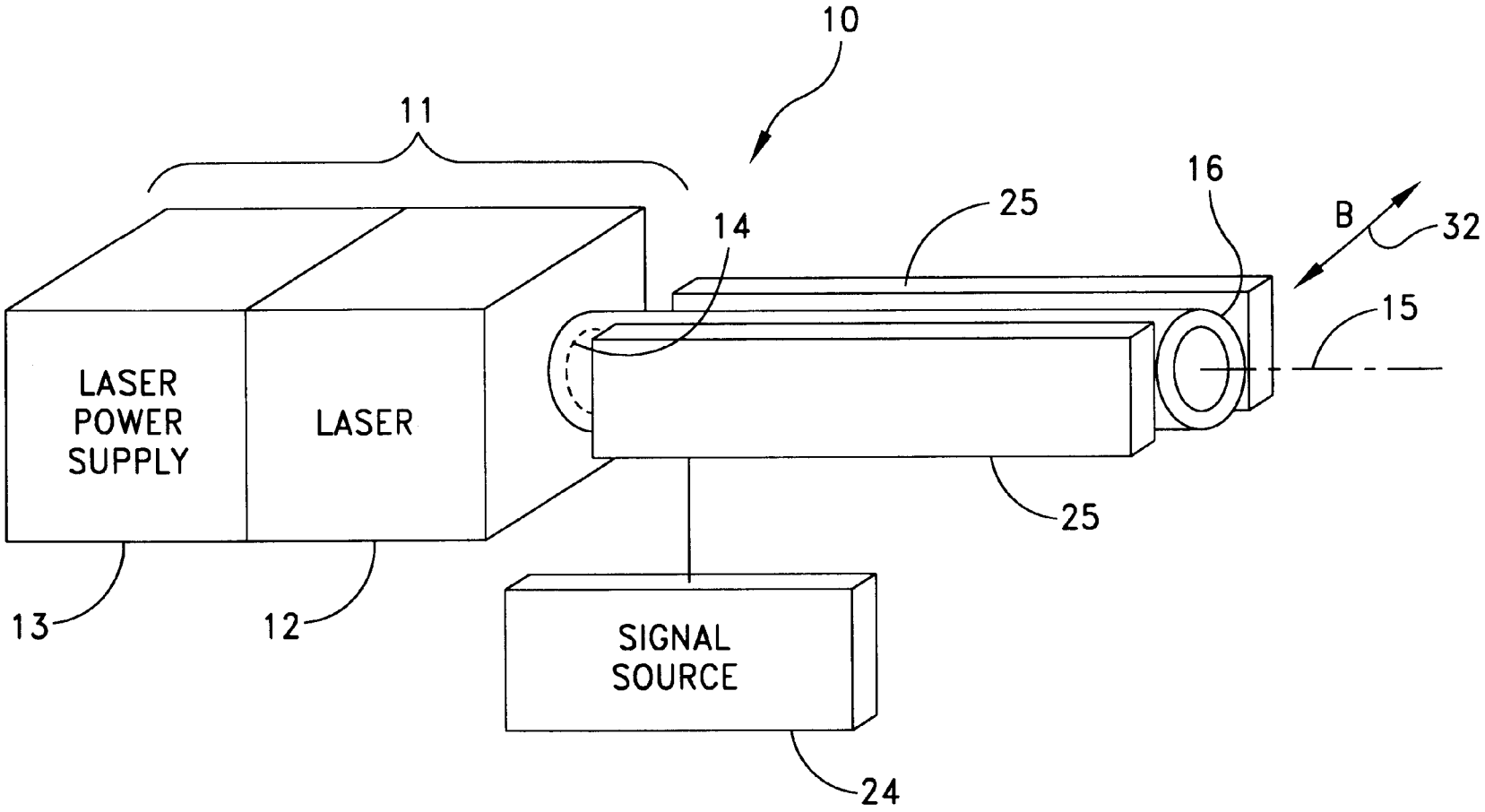
FIG. 1 is a schematic view that depicts one embodiment of a horizontal plasma antenna according to this invention.
Figure 2:
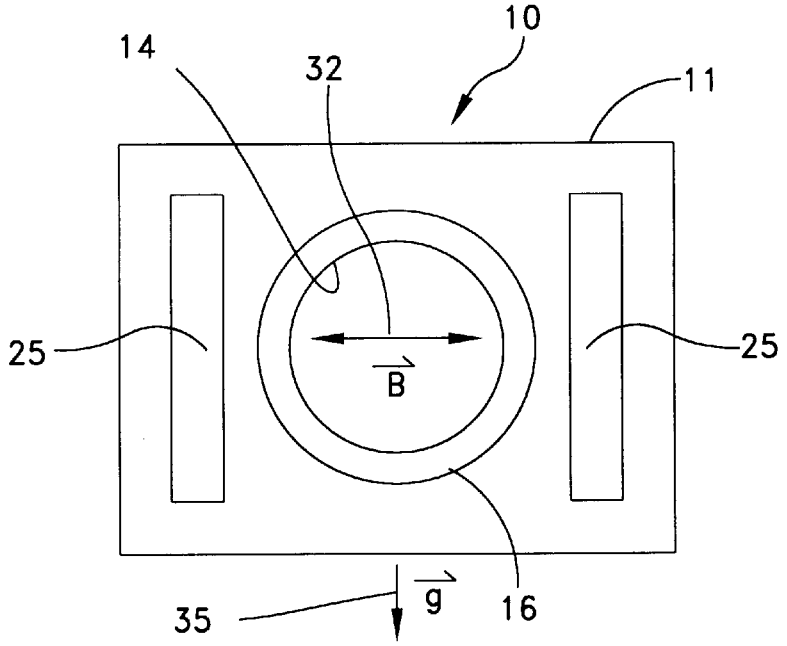
FIG. 2 is an end plan view of the horizontal ion plasma of FIG. 1 viewed from the right.

FIGS. 1 and 2 schematically depict an antenna system 10 in accordance with this invention. In this particular embodiment the antenna system 10 includes an ionizing beam generator 11 preferably in the form of a laser 12 operated by a laser power supply 13 that acts as an energizer for the ionizing beam generator 11. The laser 12 directs its emitted laser beam from an output aperture 14 along a horizontal axis 15 through a coaxial tube 16.

When the laser 12 is active, the laser beam interacts with a medium in the tube 16, normally the atmosphere, to form an ionized gas column in the tube 16. The plasma comprises ions and electrons as known in the art. A basic criterion for providing such an antenna system 10 is that the plasma in the tube 16 have an electron density of at least $10^{12}$ electrons per cubic centimeter.

For this application any ionizing mechanism including rf or electric discharge mechanisms can be substituted for the laser 12. If the tube 16 is closed, the other gases, such as the inert gases, can fill the tube 16 as the ionizable medium. Whatever the combination, it is only critical that the ionizing mechanism can achieve the above-mentioned criterion.

Although it may possible to provide that level of ionization by constantly ionizing the atmosphere, continuous wave ionizers constantly ionizing the column are prohibitively expensive. Pulse mode lasers offer a better option as ionizers. In FIGS. 1 and 2 the laser 11 may comprise a $CO_2$, Nd:YAG or other laser. Typically these lasers operate in a pulse mode with a pulse repetition frequency that is much higher than ELF. For example, a $CO_2$ laser may operate with a pulse repetition frequency (PRF) in the megahertz range; one such $CO_2$ laser operates at about 67 MHz with a 33% duty cycle.

Figure 3:
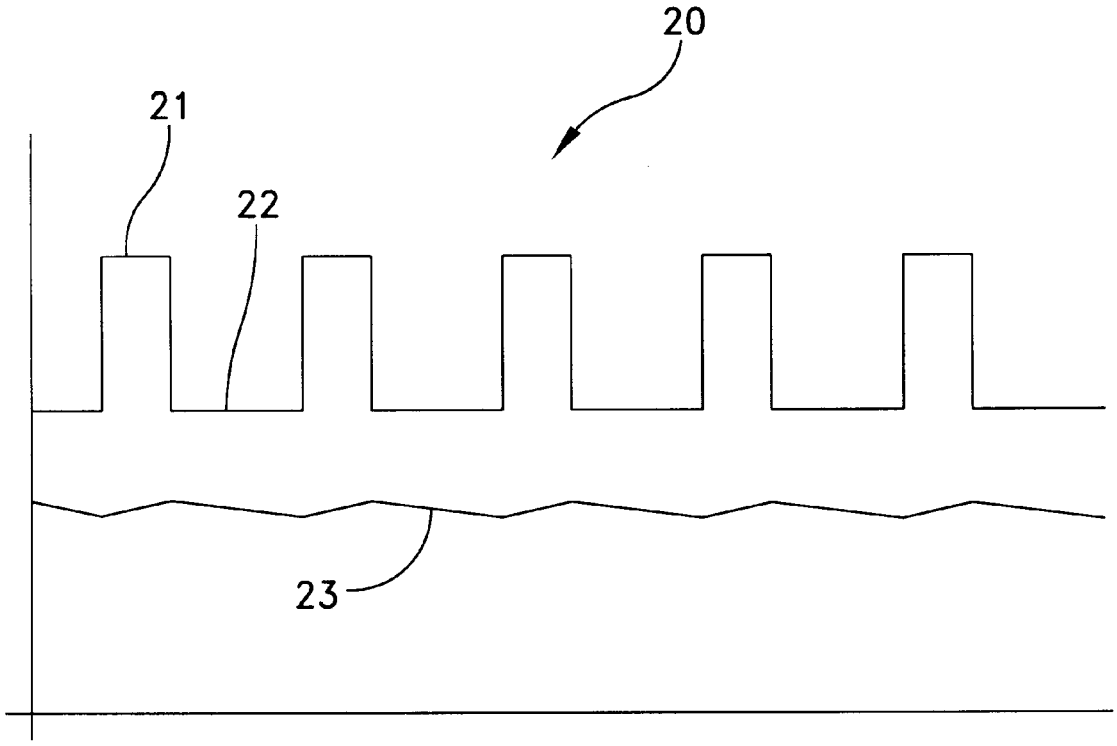
FIG. 3 is a graph that is useful in understanding this invention.

As the laser power supply 12 generates continuous pulses, the laser beam ionizes the medium in the tube 16 to form the ion plasma. More specifically, FIG. 3 depicts this action by showing a pulse train 20 at some pulse repetition frequency with the pulse train shifting between an ON level 21 and OFF level 22. The OFF time 22, between successive pulses in the pulse train 20 is selected to limit the amount of relaxation between successive pulses. For example, the interval is chosen to limit the relaxation to about 10% of the maximum ionization. A graph 23 in FIG. 3 shows the effect on the level of ionization of repetitive pulses having an OFF time corresponding to above criterion. Although there is a minor variation in the ionization level in the column during successive pulses, that variation is less than about 10% of the maximum ionization. Therefore, the variation is insignificant with respect to the operation of this invention. What is important is that the plasma in the tube 16 of FIG. 1 continue to meet the concentration criteria for the duration of any transmission.

FIG. 1 also depicts a signal processor or source 24 that produces an output signal containing information to be transmitted. The signal processor drives a Helmholtz coil set 25, shown in FIGS. 1 and 2, to generate a uniform magnetic field. In this particular embodiment, the magnetic field is horizontal and is perpendicular to the axis 15. In FIGS. 1 and 2 an arrow $\vec{B}$ 32 that lies horizontally in the end view of FIG. 2 represents this field. The two heads on the arrow 32 are included to demonstrate that the Helmholtz coil set 25 can produce a field across the tube in either direction. That is, in the orientation of FIG. 2, the magnetic field can have a north-to-south direction from right to left or from left to right.

FIG. 2 also depicts a gravity vector $\vec{g}$ 35. This represents normal gravity that will act upon the plasma in any application when the plasma axis is horizontal; i.e., parallel to a tangent to the earth's surface.

With this configuration, a charged particle in the plasma subjected to a gravity field and a horizontal magnetic field at right angles to the axis will generate a drift current, represented mathematically as $\vec{v}_{DG}^{\alpha}$. As known, this relationship is given by:

$$\vec{v}_{DG}^{a} = \frac{m_a}{q_a}\frac{\vec{g}\times\vec{B}}{q_a B^2}c \tag{1}$$

where $m_\alpha$ and $q_\alpha$ represent the mass and charge on a charged particle, such as an ion i, or electron e, and B represents the magnitude of the magnetic field vector $\vec{B}$.

The contribution of an ion as a charge carrier in the gravity and magnetic fields can be specified by:

$$\vec{v}_{DG}^{i} = \frac{m_i}{q_i}\frac{\vec{g}\times\vec{B}}{q_i B^2}c. \tag{2}$$

Equation (1) also describes the contribution of electrons by setting □=e.

Still referring to Equation (2), for an alternating field at a frequency ω and where the operator $R_e$ defines the real component, the field is given by:

$$\vec{B} = R_e \hat{\vec{B}} e^{j\omega t} \tag{3}$$

Substituting Equation (3) in Equation (2) yields:

$$\vec{v}_{DG}^{i} = \frac{m_i}{q_i}\frac{R_e \hat{\vec{B}} e^{j\omega t}}{B^2}c \tag{4}$$

that indicates the impact of ions on the drift current by introducing an alternating magnetic field. Solving this equation yields:

$$\vec{v}_{DG}^{i} = R_e\left[\frac{m_i}{q_i}\vec{g}\times\frac{\hat{\vec{B}}}{B^2}\right]e^{j\omega t} \tag{5}$$

in which the mass and charge and the peak values of gravity and magnetic field are considered collectively as a constant. Thus, the magnetic field through the plasma column is the real component of a constant field times $e^{j\omega t}$, the frequency operator.

Figure 4:
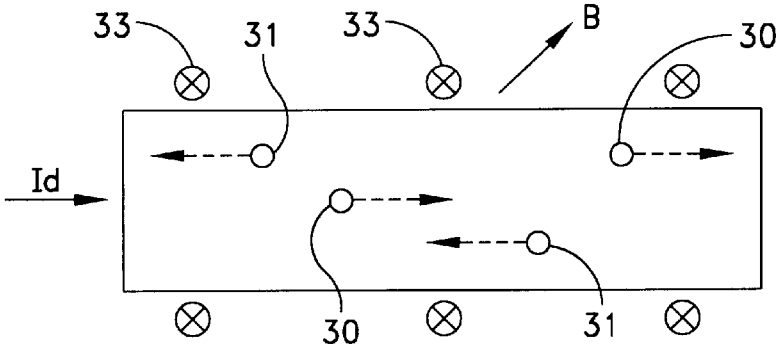
FIG. 4 depicts the travel of ions and electrons in the horizontal plasma under one set of operating conditions.
Figure 5:
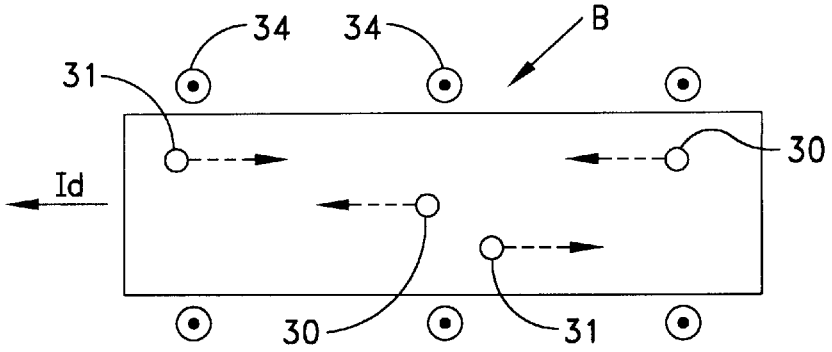
FIG. 5 depicts the travel of ions and electrons in the horizontal plasma under another set of operating conditions.

FIG. 4 depicts a portion of the plasma system in which the magnetic field is directed to enter the paper as represented by circles 33 with crosses. This represents a north-to-south field from left to right in FIG. 2. The impact is shown on ions 30 that are moving to the right and electrons 31 that are moving to the left. According to Equation (5) the velocity is determined by the magnitude of the magnetic field. When the field reverses and the field is directed out of the paper, (i.e., a north-to-south field extending from right to left in FIG. 2), the direction of travel of the ions 30 and electrons 31 reverse as shown in FIG. 5 where circles 34 containing central dots denote the field reversal with respect to the field direction in FIG. 4.

From a practical standpoint the contribution to the drift current of the ions is significantly greater than that of the electrons. However, the final drift current is the sum of the ion and electron drift currents and is given by:

$$\vec{v}_{DG} = \vec{v}_{DG}^{i} + \vec{v}_{DG}^{e} \tag{6}$$

Thus, as the magnetic field changes direction at a given frequency, ω, the current oscillates at the same frequency. It produces a large dipole moment since it is primarily ion current oscillating at the plasma frequency which is set equal to this frequency. Currents in such a horizontal plasma antenna would be greater than those in a conventional antenna, such as a horizontal electric dipole (HED) antenna, particularly for ELF applications.

As previously indicated, conventional ELF antennas have a length $L_A$ that is quite long. In accordance with conventional antenna analysis, two antennas provide equal radiation if they have an equal I*L product where I is the current in the antenna and L is the length of the antenna. Assuming the conventional antenna has a length $L_A$, the length $L_P$ of the plasma antenna will be:

$$L_P = \frac{I_A}{I_P}L_A \tag{7}$$

where $I_A$ and $I_P$ represent the currents in the conventional and plasma antennas. Thus, if the plasma generates a current $I_P$ that has a greater magnitude than the current $I_A$ of a conventional antenna, the length $L_P$ of the plasma antenna can be decreased by a corresponding amount. It is expected that the ratio $I_A/I_P$ will be in a range of about 2 to 5, and may be higher.

For applications in which the plasma column 16 in FIGS. 1 and 2 reaches well into the atmosphere a combination of increased current and length may provide even greater field strengths and dipole moments than presently available in ELF applications. That is, if $I_P > I_A$, it is possible to construct an antenna with a length that is less than the length of a conventional HED antenna. Alternatively if the lengths are the same, the horizontal plasma antenna will develop a higher electric dipole moment. At high frequencies the antenna can be more flexible than conventional solid metal antennas. Basically the length can be considerably shorter than a conventional antenna for a corresponding frequency. Moreover, the resonant frequency of the plasma is not dependent on the length of the antenna.

As the only hardware associated with the antenna includes the plasma generating mechanism, signal source and Helmholtz coils, this construction provides a compact, transportable antenna structure even for ELF applications. Moreover, this invention enables the construction of an antenna that is significantly shorter than a conventional antenna for the same frequency which provides corresponding electromagnetic radiation.

This invention has been described in terms of specific implementations. As described lasers or other ionizing mechanisms can be used to provide the plasma. Helmholtz coils are known for providing a uniform magnetic field; other magnetic field generators could be substituted. Therefore, it is the intent of the appended claims to cover all such variations and modifications as come within the true spirit and scope of this invention.

What is claimed is:

1. An antenna comprising:

means for generating a plasma column extending along a horizontal axis in a gravity field;

means for generating a magnetic field perpendicular to the horizontal axis and in horizontal planes; and means for controlling said magnetic field generating means in response to a modulating signal whereby variations in the magnetic field produce a drift current in the plasma that varies in accordance with the modulating signal, the drift current causing an electromagnetic field to radiate from the plasma that varies in accordance with the modulating signal.

2. An antenna as recited in claim 1 wherein said means for generating a plasma column comprises a laser for generating a laser beam along the horizontal axis.

3. An antenna as recited in claim 2 further comprising means for energizing said laser to generate a laser beam with sufficient energy to produce a plasma column with a concentration of at least $10^{12}$ electrons per cubic centimeter.

4. An antenna as recited in claim 3 wherein said laser includes a power supply for energizing said laser in a continuous wave mode.

5. An antenna as recited in claim 3 wherein said laser includes a power supply for energizing said laser in a pulsed mode.

6. An antenna as recited in claim 3 wherein said means for generating a magnetic field includes means for generating an electromagnetic field.

7. An antenna as recited in claim 6 wherein said means for generating an electromagnetic field includes Helmholtz coils disposed on opposite sides of the column.

8. An antenna as recited in claim 7 wherein said means for controlling said magnetic field includes means for generating the modulating signal for energizing said Helmholtz coils to produce a variable electromagnetic field.

9. An antenna system as recited in claim 6 wherein said means for controlling said magnetic field generates a signal that shifts the magnetic field 180° in the horizontal plane at the frequency of the modulating signal.

10. An antenna as recited in claim 9 wherein said means for controlling said magnetic field generates a signal having a frequency $_\omega$ and the electromagnetic field is represented by $\hat{\vec{B}}e^{j\omega t}$ such that the drift current is:

$$\bar{v}_{DG}^{a} = \mathrm{Re}\left[\frac{m_a}{q_a}\frac{\vec{g}\times\hat{\vec{B}}}{B^2}\right]e^{j\omega t}$$

where $m_\alpha$ and $q_\alpha$ represent the mass and charge on a charged particle in the plasma, $\hat{\vec{g}}$ and $\hat{\vec{B}}$ are gravity and electromagnetic fields vectors, respectively, B represents the magnitude of the electromagnetic field and $R_e$ is an operator defining a real component of the field.

11. An antenna comprising:

a laser for directing a laser beam along a horizontal axis in a gravity field thereby to produce a plasma column in a gravity field;

Helmholtz coil means for generating an electromagnetic field perpendicular to the horizontal axis; and a modulator for generating a modulated signal at a reference frequency thereby to control the energization of the Helmholtz coil means whereby there is produced in the plasma a modulated drift current at the reference frequency that radiates a corresponding electromagnetic field.

12. An antenna as recited in claim 11 wherein said laser comprises a laser power supply for energizing said laser in a continuous wave mode.

13. An antenna as recited in claim 11 wherein said laser comprises a laser power supply for energizing said laser in a pulsed mode.

14. An antenna system as recited in claim 11 wherein said modulator generates a signal that shifts the magnetic field 180° in the horizontal plane at the frequency of the modulating signal.

15. An antenna as recited in claim 14 wherein said modulator generates a signal having a frequency $_\omega$ and the electromagnetic field is represented by $\hat{\vec{B}}e^{j\omega t}$ such that the drift current is:

$$v_{DG}^{a} = \mathrm{Re}\left[\frac{m_a}{q_a}\frac{\vec{g}\times\hat{\vec{B}}}{B^2}\right]e^{j\omega t}$$

where $m_\alpha$ and $q_\alpha$ represent the mass and charge on a charged particle in the plasma, $\hat{\vec{g}}$ and $\hat{\vec{B}}$ are gravity and electromagnetic fields vectors, respectively, B represents the magnitude of the electromagnetic field and $R_e$ is an operator defining a real component of the field.

16. A method for radiating an electromagnetic field in response to a modulating signal comprising the steps of:

generating a plasma column extending along a horizontal axis in a gravity field;

generating a magnetic field perpendicular to the horizontal axis and in horizontal planes; and controlling the generation of the magnetic field in response to the modulating signal whereby variations in the magnetic field produce a drift current in the plasma that varies in accordance with the modulating signal, the drift current causing an electromagnetic field to radiate from the plasma that varies in accordance with the modulating signal.

17. A method as recited in claim 16 wherein said step of generating a plasma column includes directing a laser beam along the horizontal axis with an energy sufficient to produce a plasma with a concentration of at least $10^{12}$ electrons per cubic centimeter.

18. A method as recited in claim 17 wherein said step of generating a magnetic field includes generating an alternating electromagnetic field with Helmholtz coils whereby the electromagnetic field is shifted by 180° in the horizontal plane.

19. A method as recited in claim 18 wherein said step of controlling the generation of the magnetic field generates a signal having a frequency $\omega$ and the electromagnetic field is represented by $\hat{\vec{B}}e^{j\omega t}$ such that the drift current is:

$$\hat{\vec{v}}_{DG}^{\sigma} = \mathrm{Re}\left[\frac{m_i}{q_i}\frac{\vec{g}\times\hat{\vec{B}}}{B^2}\right]e^{j\omega t}$$

where $m_i$ and $q_i$ represent the mass and charge on an ion in the plasma, $\hat{\vec{g}}$ and $\hat{\vec{B}}$ are gravity and electromagnetic field vectors, respectively, B represents the magnitude of the electromagnetic field and $R_e$ is an operator defining a real component of the field.

* * * * *